US006057774A

United States Patent [19]

Venzant

[11] Patent Number: 6,057,774

[45] Date of Patent: May 2, 2000

[54] SMOKE ALARM WITH ANTI-DUST SCREEN

[75] Inventor: Kenneth Lee Venzant, Boling Brook, Ill.

[73] Assignee: BRK Brands, Inc., Aurora, Ill.

[21] Appl. No.: 09/234,536

[22] Filed: Jan. 21, 1999

[51] Int. Cl.[7] ..... G08B 17/10

[52] U.S. Cl. ..... 340/628; 340/630; 340/286.05; 340/629; 250/381; 250/574; 365/338

[58] Field of Search ..... 340/628, 630, 340/286.05, 629; 250/381, 574; 365/338

[56] References Cited

U.S. PATENT DOCUMENTS

| | | | |
|---|---|---|---|
| 3,470,551 | 9/1969 | Jaffe et al. | 340/237 |
| 3,710,365 | 1/1973 | Barnes | 340/237 |
| 3,824,422 | 7/1974 | Van der Walt et al. | 313/218 |
| 3,908,957 | 9/1975 | Schutt | 250/384 |
| 4,286,159 | 8/1981 | Kitta et al. | 250/381 |
| 4,672,217 | 6/1987 | Dobrzanski | 250/574 |
| 4,851,819 | 7/1989 | Kawai et al. | 340/630 |
| 5,327,119 | 7/1994 | Ishii | 340/629 |
| 5,400,014 | 3/1995 | Behlke et al. | 340/630 |
| 5,546,074 | 8/1996 | Bernal et al. | 340/628 |
| 5,617,077 | 4/1997 | Wiemeyer et al. | 340/628 |
| 5,633,501 | 5/1997 | Amleshi et al. | 250/381 |
| 5,781,291 | 7/1998 | So et al. | 356/338 |
| 5,818,326 | 10/1998 | Winterble et al. | 340/286.05 |

*Primary Examiner*—Daniel J. Wu
*Assistant Examiner*—Tai T. Nguyen
*Attorney, Agent, or Firm*—Rockey, Milnamow & Katz. Ltd.

[57] ABSTRACT

Smoke alarms that incorporate dust repelling screens exhibit improved performance with fewer false alarms. Effective screens include conductive strands combined with non-conductive elements.

18 Claims, 6 Drawing Sheets

SMOKE ALARM WITH ANTI-DUST SCREEN

FIELD OF THE INVENTION

The invention pertains to ambient condition detectors. More particularly, the invention pertains to dust resistant detectors.

BACKGROUND

Smoke alarms are prone to dust and dirt build-up after prolonged use. Dust and dirt build-up may cause the smoke alarm to malfunction or give a false alarm.

In the case of a photoelectric detector, the photo chamber must be removed and/or vacuum cleaned to restore the detector to normal operation. The sensors in ionization sensors, must also be vacuumed. Furthermore ionization sensors are also prone to dust and dirt build-up and may cause the unit to false alarm. False alarms in this case result from dirt/dust build-up at or around the center and base electrodes causing a short which will increase the electrode voltage causing the unit to false alarm.

Conductive screens have been used in prior art detectors to exclude bugs or other overly large particulate matter. Prior art screens have also been used to limit air flow into or out of the sensing chamber.

There is a continuing need to address the issues raised by such buildups. It would be desirable to be able to repel dust to eliminate, as much as possible, the build up problem. Given the cost effective nature of residential detectors and the competitive nature of the retail market, no solution which significantly increases detector cost will be successful. Hence, any successful attempt to solve the problem will not only provide a repellant function but will also do so cost effectively.

SUMMARY

The present invention relates to cost effective improvements in both light scattering type smoke detectors or smoke alarms and ionization smoke detectors or smoke alarms. A screen material is formed of a conductive fabric and is designed to repel and/or dissipate aerosol dust particles but will not repel smoke particles. The screen is also effective at promoting EMC and therefore reflects damaging electrostatic and electromagnetic energy (low frequency radiation). This should have tangible benefits in electromagnetically protecting the photodetector in the housing of the photoelectric smoke alarm. The screen sets up a electrostatic/conduction field that repels/dissipates dust build-up in the sensor's housing.

A carbonized polymer screen material is essentially a semiconductor operating in the mid range of a typical insulator and conductor. The material facilitates for continuous and safe discharge of charged electrons via surface conduction. The charge dissipation falls in the range of 104 to 2011 ohms.

Dust and dirt aerosols are prevented from accumulating inside the sensing chambers of both ionization and photoelectric smoke alarms. The screen also has the capability to protect the sensors in each case from low frequency electromagnetic fields (up to 100 MHz near field and higher). Therefore the smoke alarm's performance will be enhanced by improving the sensor (photoelectric and ionization), circuitry, and sensing chambers through dust rejection and give the units EMC capability.

Furthermore since the material is of a polymeric/carbon nature it will not suffer from corrosion and oxidation over time as in many other smoke alarms that use metal as a screen mesh material. The mesh in these units however is primarily used for insect deterrence.

In yet another aspect, a preferred embodiment involves the use of a woven screen comprised of a combination of plastic (nylon) material and carbonized threads. This highly conductive screen is intended to dissipate static charges as well as statically charged dust and dirt particles. It will also reflect harmful electromagnetic interference radiation.

The ratio of pore size to open area is so chosen as to allow the entry of particulate matter associated with smoke and block the entry of dust particles of a larger size. Furthermore, if the dust/dirt particles are of comparable size then they will be repelled due to their charge. Smoke particles are also known to carry a charge. However, they exhibit a pressure gradient and velocity they can easily penetrate the screen pores and enter the sensing chamber.

The conductive polymeric screen is usable in photoelectric as well as ionization smoke alarms. For photoelectric smoke alarms the screen is used for dust interception and dissipation thus preventing dust build-up in the sensor. Its use in ionization smoke alarms is for electromagnetic shielding as well as to prevent dust accumulation.

The ionization detector is improved by the screen since dust, dirt and lint (tiny threads) cannot interact with the ion pair recombination effects which can thus improve the chambers overall signal to noise. It may also alleviate accumulation along with surface charge build-up due to the electric field prematurely interacting with the insulator of a typical ionization sensor which could also affect the signal to noise and V/I characteristics.

Smoke alarms incorporating a conductive polymer screen according to the present invention show improved performance in environments where there is dust and/or certain environmental aerosols. Smoke alarms in home and in some industrial environments would benefit from the presence of such screens in that they are known to suffer from dust and/or aerosol contamination.

Particulate matter may build-up in the sensor causing the unit to false alarm or malfunction in scattering type smoke alarms. Essentially, in the light scattering type smoke alarms, dust and/or aerosols can enter the sensor and adhere to the walls of the sensor and optical components. This in turn causes an increase in noise received by the photodetector incorporated in the sensing chamber. The conductive screen eliminates this problem by dissipating any particles that are attracted to the screen or scatters particles moving at non-convective room velocities. The screen does allow the passage of combustible products since particulates associated with combustion move at high convective velocities.

The same principle can be applied to ionization smoke alarms by providing protection against charge build-up, dust accumulation and EMI. Particulate matter may build-up in the ionization chamber and cause interference with the radioactive cloud which is extremely critical for the proper detection of smoke/combustion products.

The screen essentially allows the natural flow of air in the sensing chamber but will not allow dust in the sensing chamber. Furthermore combustible aerosols are free to flow through the screen since they carry a concentration gradient (velocity gradient) that exceeds natural (undisturbed) aerosol velocities.

The conductive polymer screen (CPS) can be located in the perforated housing of the smoke alarm. In this configuration the housing alone with the CPS screen mesh forms part of the vents or perforations can be the first line of defense against dust and/or noncombustible aerosols. The conductive screen can be used as an electrostatic and EMI (low frequency) shield by surrounding the sensor with the screen.

A conductive screen can be formed without the use of a polymer in the matrix. The material described above is a hybrid screen material. In yet another embodiment, the screen includes a totally carbon black fibrous material to be utilized in the most challenging dust environments such as warehouses, attics and basements and/or rooms whereby heavy construction causes major aerosol deployment in the air.

The screen can have various geometries, depending on the application. Although the preferred form of the screen is a square-type twig, other geometries may include, hexagonal, triangular, diamond and crisscross configurations.

Materials have the capability of surrendering their electrons or to getter electrons due to the nature of the materials conductivity. For instance, copper is a material that does not readily give up its electrons due to its molecular construction, since copper is a pure conductor. However, materials such as certain semiconductors lose electrons fairly easily. This phenomena can be found in bond type papers. The electrons in these materials are lost by heat, friction or pressure. Continuing down the line to non-conductive materials such as most plastics it is very easy to disturb the molecular configuration of the material and cause it to charge with minuscule friction, heat or pressure. Furthermore, in conducting materials, the electric field is zero everywhere, viz., $\nabla \cdot E=0$, and from Gauss's law the charge density of the conductor is zero. Charges in general reside on the surface of conductors, where the forces are strong—keeping them from easily dissipating or disassociating from the surface. These charges unlike those of insulators such as plastic or paper are "not free". Furthermore, the electric field must be normal to the surface. Therefore tangential components do not exist, if they did, surface charges in conductors could move along the surface or become free to leave the surface creating a modus for static charge build-up—as seen in plastics and papers.

To protect surfaces—especially plastics, from static build-up, one can simply add surface conductivity to the plastic in order to move it into a higher conductivity range. This is accomplished via the use of moisture additives and anti-static sprays (or even adding metallics to the fabric). These two processes however have a life span of only about 2 to 3 years. For sprays the antistatic properties simply degrade over time. When metallics are added the material becomes too brittle and therefore prone to cracking and peeling due to applied stress. One can also use carbonized threads as a static eliminator. The carbonized threads in a woven fabric can be used for electrostatic reduction and discharge avoidance. Carbonized threads have a longer life than surface treated plastics or metallics. When dust particles (most likely to have a positive charge—due to their make-up) move toward a plastic they instantly attach since the plastic is an insulator with a negative charge. If the plastic was conductive the dust particles will repel from the conductive surface of the plastic. A conductive fabric marketed under the name Carbotex® is suitable screen material. This is a precision woven screen manufactured by Sefar America (formerly Tetko, Inc.) of 111 Calumet St, Depew, N.Y., 14043-3799. The material is produced using carbonized nylon threads interwoven with nylon. Since it is conductive it will not allow free motion of electrons and will therefore dissipate static charges and charged dust and dirt particles or aerosols. This type of conductive screen extends the useful life of smoke alarms providing immunity to dust build-up in the photochamber sensor of photoelectric smoke alarms as well as the ionization sensors in ionization type smoke alarms. Other manufacturers of conductive type materials, cloths and fibers include: Kinetronics corporation, 1778 Main St., Sarasota, Fla., 34236 its material is called Z-Cloth® including-Z-5030-C Sheer Shield, Z-3250-CN Z-Shield® and Z-Shield-UL™ and BASF, Fiber products division, Charlotte, N.C., its material is Resistat®.

Numerous other advantages and features of the present invention will become readily apparent from the following detailed description of the invention and the embodiments therof, from the claims and from the accompanying drawings.

DETAILED DESCRIPTION

Figure 1:
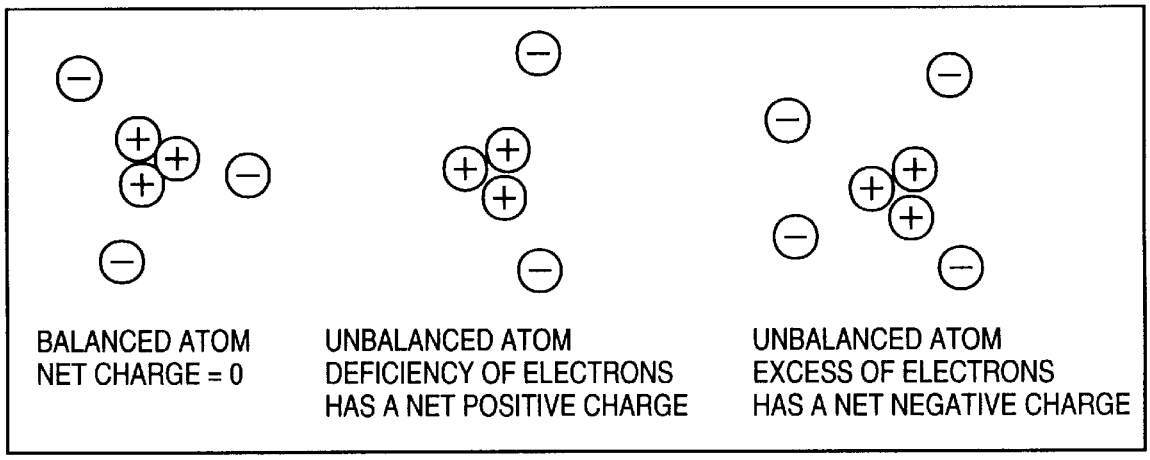
FIG. 1 is a diagram illustrating various charge conditions.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

Dust build-up in optical smoke alarm and ionization smoke alarm sensors can be alleviated by employing anti-static electricity. Static electricity is created by unbalancing the molecular arrangement of fairly homogeneous non-conductive insulators such as plastics and paper.

All matter is composed of atoms, and atoms contain positive charges present in the nucleus of the atom along with an equal amount of negative charges (electrons) that orbit this nucleus Since both the positive and negative charges are equal the overall charge balance is zero, see FIG. 1. However if this charge balance configuration is disrupted and several electrons are removed from the atom, there will exist a larger number of positive charges left in the nucleus with a deficiency of electrons (the atom is said to have a net positive charge). This arrangement will generate an overall charge in the positive direction. The converse is true if we added several electrons, there will exist an overall net negative charge.

Static electricity is therefore the imbalance of positive and negative charges and is the primary reason why smoke alarm sensors receive dust build-up. This is primarily the case for light scattering smoke alarm sensors since they suffer from dust accumulation due to the static field residing on the surface of the sensor's plastic housing.

Dust accumulation is also a nuisance to ion smoke alarms and these products may also benefit from a conductive polymer screen. An ionization smoke alarm's problem with dust build-up results from the effect dust could have on the radiation pattern.

If dust aerosols interact with this radiation pattern emanating from the radioactive source, anomalies of the ion recombination effects may ensue resulting in a reduction in current flow which in turn may result in the threshold of the alarm circuit to trigger resulting in an alarm. Or these aerosols may interfere with the ion pairs and distort their recombination which could result in reducing the signal to noise and/or V/I characteristics. Dirt/dust build-up could cause unwanted shorts in the ionization chamber and thus will distort the electrical characteristics of the chamber causing a false signal/alarm.

One of the primary problems with photoelectric smoke alarms is dust, dirt, and film build-up. This occurs because of the polar nature of plastics. Since they are insulators, surface charges are easily imbalanced and therefore the surface serves as a haven for dust particles. Sophisticated baffling designs to reduce dust, dirt, and film build up are generally employed in optical smoke alarms. Still other smoke alarm manufacturers develop complex software algorithms that compensate for dust build-up in the sensor's chamber. These designs, however, are not enough to keep the surfaces and optical components from becoming degraded. Dust, dirt and film build-up can easily cause photoelectric smoke alarms to false alarm.

In accordance herewith, the sensors used in light scattering smoke alarms exhibit enhanced immunity to dust accumulation by placing a conductive material around the smoke entry vents. With the conductive screen of this invention these complex procedures and designs are not necessary. Furthermore, upon application of this type of screen with its EMC and anti-dust capability, sensor instability for light scattering smoke alarms becomes almost negligible as well as that of the ionization type detectors also benefit from such screens.

Figure 2:
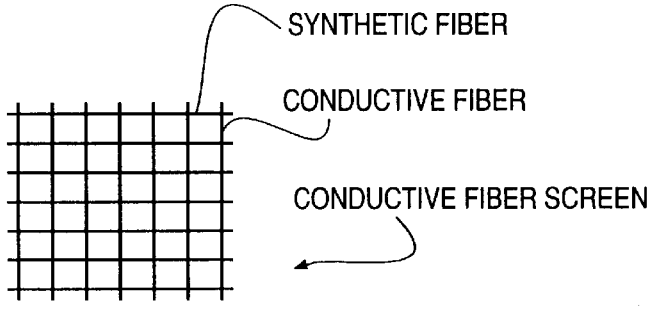
FIG. 2 is an elevational view of a conductive fiber screen.

Referring to the drawing shown in FIG. 2, a suitable conductive screen consists of a synthetic material and carbonized threads. The screen has a 0.0057 micron (0.0157") pore size with a 38% open area. The screen of FIG. 2 can be formed of CARBOTEX®-Type screen material. Other similar materials can also be used.

Figure 3:
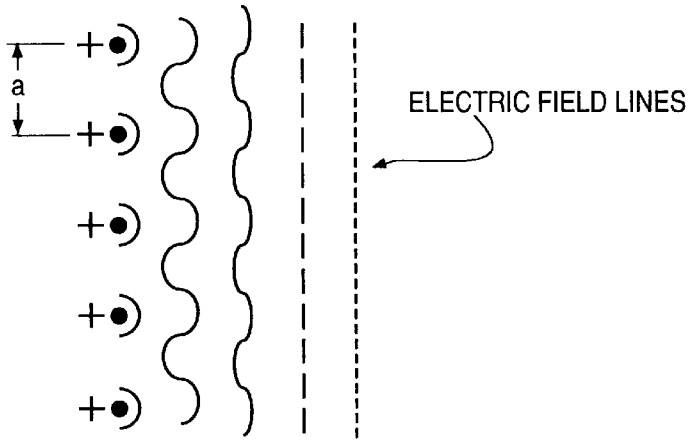
FIG 3 is a diagram of equipotential surfaces subjects adjacent a screen as illustrated in FIG. 2.
Figure 4:
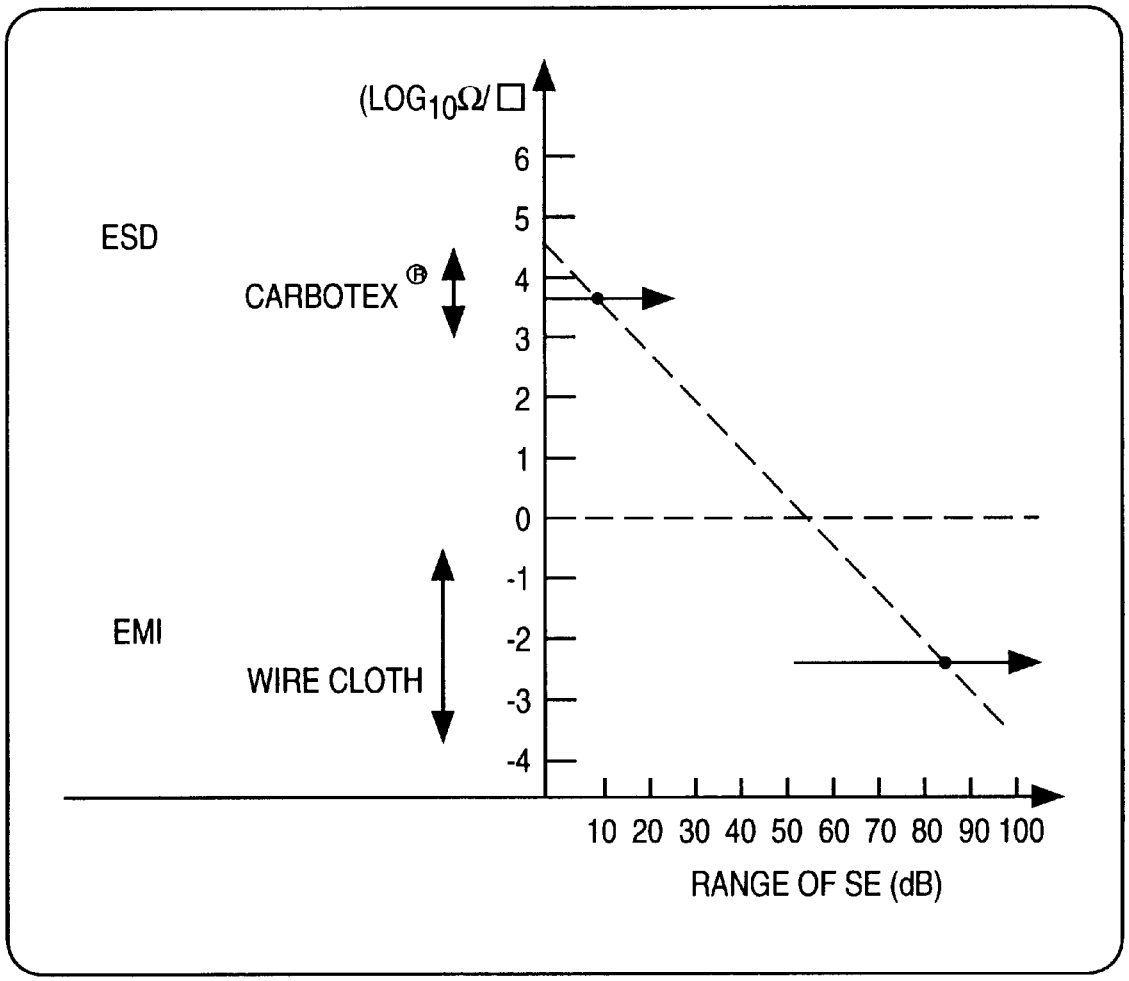
FIG. 4 is a graph of resistivity vs. shielding effectiveness.

The effect of a charged particle and/or electric field on the conductive screen is displayed in FIG. 3. FIG. 4 illustrates the electrical resistivity vs. Shielding effectiveness, where the shielding effectiveness (SE) is given in decibels (db).

Since dust particles are statically charged by nature, they can be dissipated by conductive fabrics that have an anti-statically charged force field (conductive field) that has the ability to dissipate charges since it cannot be made to have charge imbalance. This can be visualized by the following equation:

$$F = \left| k \sum_{j=1}^{n} q_i q_j / r^2 \right| \qquad 1)$$

where, $q_i$ represents the charge on the dust and $q_j$ represents the charges on the screen, r is the distance between the screen and the dust particle, n represents a system of n number of charges and k is Coulomb's constant.

This equation is positive (absolute value) since it simply represents that the force F repels the charge q of the dust particle. Dust particles will not be attracted to the screen because the screen cannot be made static due to its conductive nature (charges cannot build-up on the screens surface). Furthermore, since the screen is conductive, it will dissipate any charges trying to getter unto its surface—thus an anti-static screen.

The conductive fiber screens may serve a better purpose than existing solid metal sheets. This can be proved by examining equipotential surfaces above or away from a uniformly charged grid of conductive fibers as in FIG. 3. If the conductive fibers lie in the xz-plane running parallel to the z-axis then the following term applies:

$$\phi(x, z) = F_n(z)\cos\frac{2\pi nz}{a} \qquad 2)$$

where a is the spacing of the conductive fiber and n is the harmonic number since we are dealing with a uniform periodic fluctuating electric field and $\phi(x,y)$ is the potential function. Equation 2 results from the fact that any periodic quantity can be expressed as a sum of Fourier Series (sine's and cosine's). If the potential in equation 2 is valid, then it must satisfy Laplace's equation in the area away from the fiber grid (where charges do not exist), viz., $$\nabla^2 \phi = \frac{\partial^2 \phi}{\partial x^2} + \frac{\partial^2 \phi}{\partial z^2} = 0 \qquad 3)$$

Upon substituting $\phi$ from equation 2 into 3 we get $$\frac{-4\pi^2 n^2 x}{a^2} F_n(z)\cos\frac{2\pi nx}{a} + \frac{d^2 F_n}{dz^2}\cos\frac{2\pi nx}{a} = 0 \qquad 4)$$

Which must satisfy $$\frac{d^2 F_n}{dz^2} = \frac{4\pi^2 n^2}{a^2}$$

And therefore we must have $$F_n = A_n e^{-z/z_0}$$

From this expression, the Fourier component of the field having harmonic n, will decrease exponentially with a certain distance $z_0 = a/2\pi n$. Now for the first harmonic (n=1), the amplitude falls by a factor of $e^{-2\pi}$ each time y is increased by a grid spacing a. Now additionally, as one moves away from the grid the other harmonics fall off even faster. Furthermore, if we are a few times the distance a, away from the grid the field is fairly uniform, i.e., the oscillating terms are small.

The electric field lines are likened to charged dust/dirt particles, viz., as the particles are far away from the grid of conducting fibers they are unaffected. However, as the particles get nearer to the grid their electrostatic field will be repelled by that of the conductive fiber, i.e., the particles do not have an electronic affinity for the grid of conductive fiber. More importantly, the charged grid shield will substantially terminate an electrostatic field such as those carried by dust and dirt aerosols.

The present invention also applies to dual sensors (photoelectric and ion) in one unit. The invention is also applied to interconnected smoke alarms and interconnected smoke alarms with battery back-up.

Figure 5:
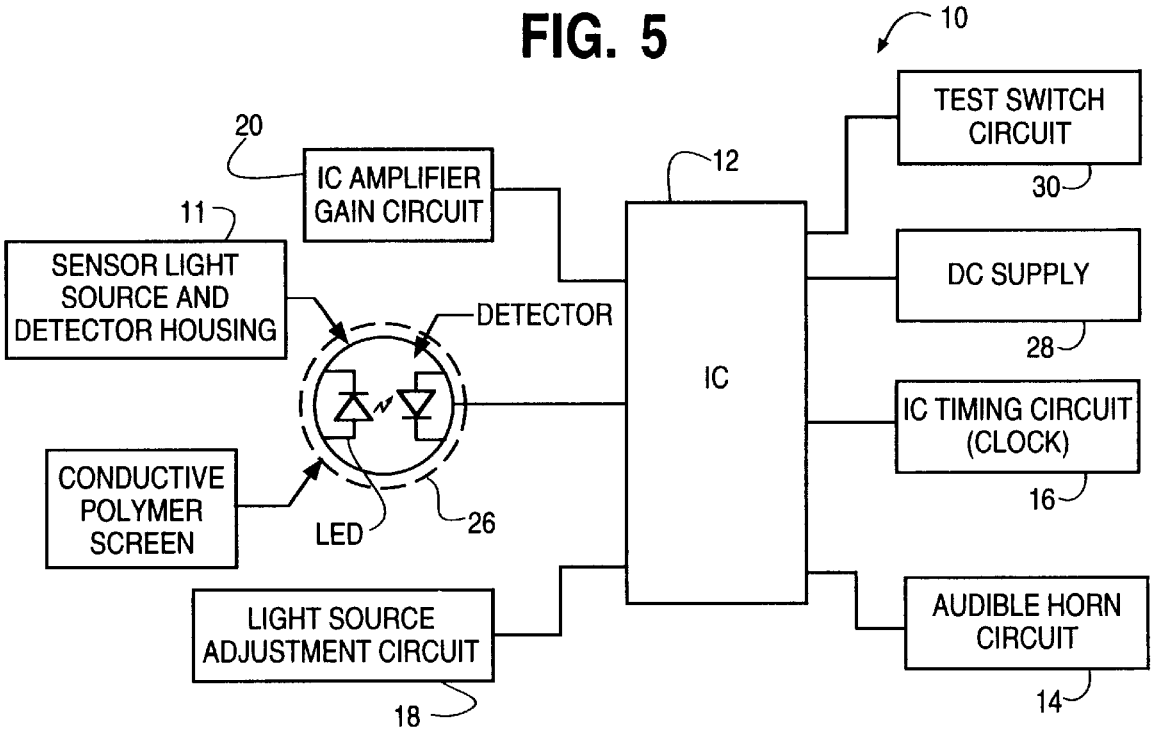
FIG. 5 is a block diagram of a photoelectric detector in accordance with the present invention.
Figure 6:
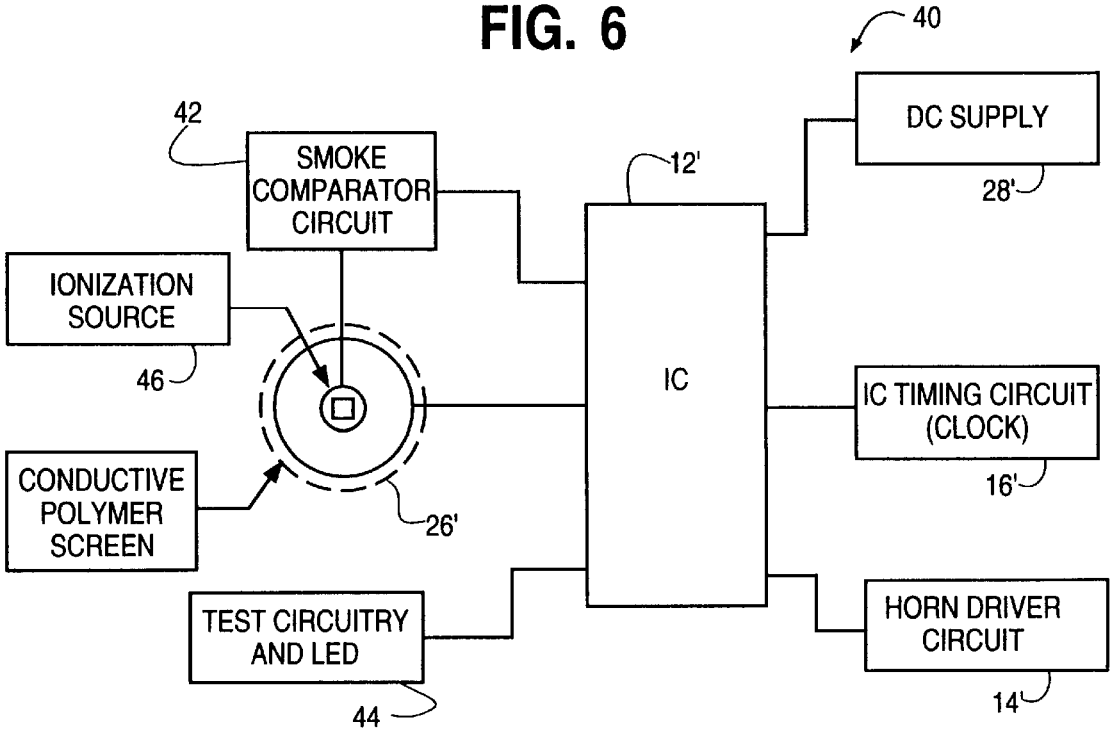
FIG. 6 is a block diagram of an ionization-type detector in accordance with the present invention.

FIG. 5 is a block diagram of a photoelectric smoke alarm 10 in accordance with the present invention with a conductive polymer screen; FIG. 6 illustrates a block diagram of an ionization smoke alarm with a conductive polymer screen.

With reference to FIG. 5, the photoelectric detector 10 includes a sensing chamber 11, and an integrated control circuit, 12 which provides all of the essential analog and digital control functions. This integrated circuit is publicly available, for example, a Motorola type MC145011 used for control of photoelectric smoke alarms.

The circuit 12 is coupled to supporting peripheral circuitry including circuitry for an alarm driver 14, timing, 16, infrared light source adjustment, 18, gain control circuitry 20 and sensor detection (amplifier and comparator). Finally, the detector 10 includes a conductive polymer screen 26. A dc supply 28 and test switch circuitry 30 are also illustrated.

With reference to FIG. 6, an ionization detector 40, includes an integrated circuit, 12', which provides all of the necessary analog and digital control functions. This IC is also publicly available, for example a Motorola type MC14470. The IC 12' is coupled to peripheral circuitry for the alarm driver, 14', timing, 16', voltage supply, 28', comparator/sensor circuitry, 42, and test circuitry, 44. The design also incorporates a conductive polymer screen, 26' and an ionization source/sensor, 46.

Figure 7:
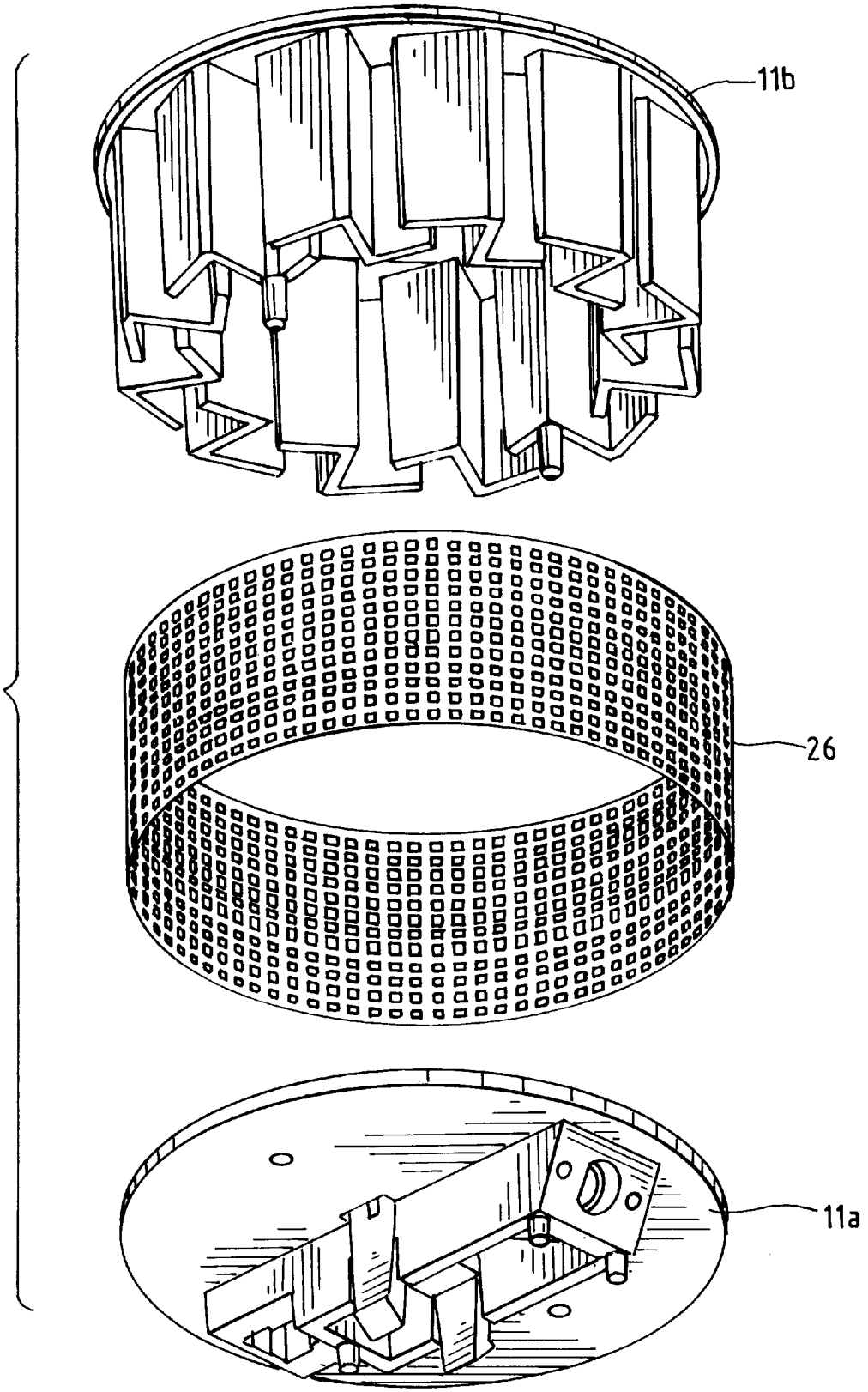
FIG. 7 is an exploded view of the detector of FIG. 5.

FIG. 7 is an illustration of the conductive screen 26 surrounding a photoelectric smoke alarm sensor chamber 11*a, b*. The screen, 26 surrounds the outer walls 11*b* of the chamber. The conductive screen can serve both the role of dust shielding as well as EMI shielding.

Figure 8:
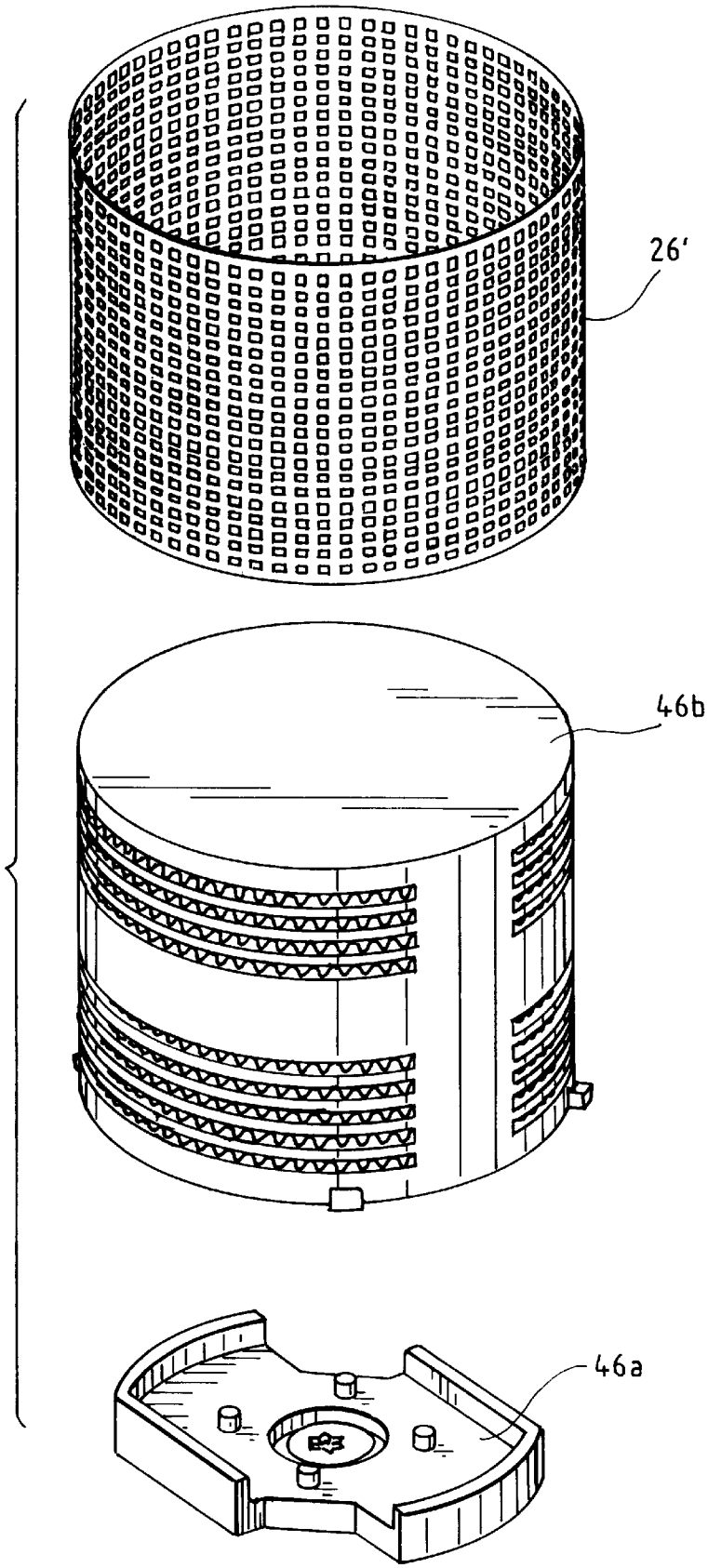
FIG. 8 is an exploded view of the detector of FIG. 6.

FIG. 8 illustrates the screen 26' incorporated in an ionization sensor. The screen, 26' in this application can also serve two functions, one is dust shielding of the chamber 46*a, b*. The other function is that of reducing the space charging effects of the insulation used in the ionization chamber.

Figure 9:
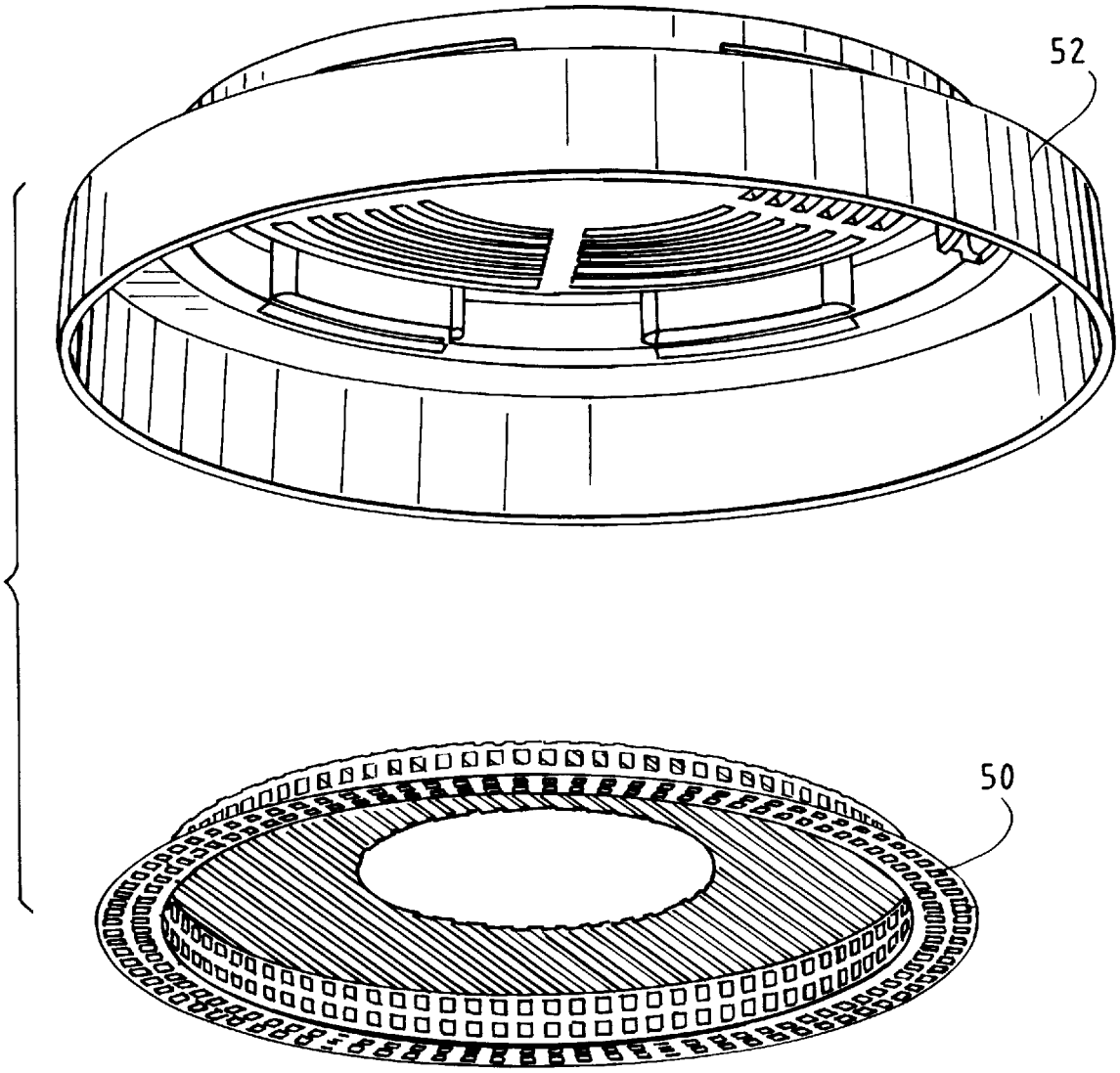
FIG. 9 exploded view of an alternate form of a detector.

FIG. 9 illustrates a screen 50 located in a generic smoke alarm exterior cover 52. FIG. 9 also illustrates the conductive screen as incorporated in smoke alarm cover 52. In this form, the screen, 50 can perform a dual role for the most demanding dust prone environments.

Detectors of the present invention can be independent stand alone units with or without battery backup. Alternately, a group of detectors can be interconnected for example by an interconnect conductor, at an interconnect part on each of the units.

From the foregoing, it will be observed that numerous variations and modifications may be effected without departing from the spirit and scope of the invention. It is to be understood that no limitation with respect to the specific appartus illustrated herein is intended or should be inferred. It is, of course, intended to cover by the appended claims all such modifications as fall within the scope of the claims.

What is claimed:

1. An ambient condition detector comprising:

an ambient condition sensor open to an adjacent ambient atmosphere; and a semiconductive screen between the sensor and the adjacent ambient atmosphere wherein the screen exhibits spaced apart openings sized for ingress of selected airborne particulate matter and, in part, conductive for draining charges from non-selected particulate matter.

2. A detector as in claim 1 wherein the screen has a substantially circular cross section and surrounds the sensor.

3. A detector as in claim 2 wherein the openings of the screen exhibit a rectangular shape.

4. A detector as in claim 1 which includes a housing with a perforated cover wherein the housing defines an internal region for the sensor and wherein the screen is carried by the housing between the cover and the sensor.

5. A detector as in claim 2 wherein the sensor comprises a photo-electric smoke sensor.

6. A detector as in claim 4 wherein the sensor comprises a photo-electric smoke sensor.

7. A detector as in claim 5 wherein the screen includes non-conductive fibers interwoven with conductive fibers.

8. A detector as in claim 5 wherein the screen includes non-conductive fibers in combination with conductive fibers.

9. A detector as in claim 6 wherein the screen includes non-conductive fibers in combination with conductive fibers.

10. A detector as in claim 6 including a housing and wherein the screen encloses the sensor and along with the housing forms an EMI shield.

11. A smoke alarm comprising:

a perforated housing which defines an internal volume;

a smoke sensor, carried in the housing and exposed to adjacent ambient atmosphere via the perforations; and an ungrounded semicoductive anti-static screen, carried by the housing, located between the sensor and the adjacent ambient atmosphere.

12. A detector as in claim 11 wherein the screen includes a plastic combined with conductive, carbonized material to dissipate static charges on dust and dirt.

13. A detector as in claim 12 wherein plastic threads are combined with carbonized threads.

14. A detector as in claim 13 wherein the plastic threads are interwoven with the carbonized threads.

15. A detector as in claim 13 wherein the screen is cylindrical.

16. A detector as in claim 13 wherein the screen comprises a layer formed to conform to a portion of the housing adjacent the perforations.

17. A detector as in claim 13 wherein the smoke sensor comprises a photoelectric sensor.

18. A detector as in claim 13 which includes a battery.

* * * * *